US008427519B2

(12) United States Patent
Umezawa

(10) Patent No.: US 8,427,519 B2
(45) Date of Patent: Apr. 23, 2013

(54) ELECTROPHOTOGRAPHIC IMAGE FORMING APPARATUS WITH MOVABLE LIGHT EMITTING MEMBER SUPPORT

(75) Inventor: Masao Umezawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 12/707,219

(22) Filed: Feb. 17, 2010

(65) Prior Publication Data

US 2011/0050834 A1 Mar. 3, 2011

(30) Foreign Application Priority Data

Aug. 27, 2009 (JP) ..... 2009-196727
Dec. 22, 2009 (JP) ..... 2009-290044

(51) Int. Cl.
*B41J 2/435* (2006.01)

(52) U.S. Cl.
USPC ..... 347/245; 347/224

(58) Field of Classification Search ..... 347/245, 347/224; 399/125, 118, 149, 111, 51, 205
See application file for complete search history.

(56) References Cited

U.S. PATENT DOCUMENTS

| | | | | |
|---|---|---|---|---|
| 5,414,493 | A | 5/1995 | Fujii et al. | |
| 5,471,284 | A | 11/1995 | Fujii et al. | |
| 5,978,626 | A * | 11/1999 | Nagamine et al. | 399/125 |
| 7,991,325 | B2 | 8/2011 | Yamaguchi | |
| 8,208,834 | B2 | 6/2012 | Yamaguchi | |
| 2001/0021321 | A1 * | 9/2001 | Kikuchi et al. | 399/118 |
| 2004/0126139 | A1 * | 7/2004 | Yoshizawa et al. | 399/149 |
| 2009/0087210 | A1 | 4/2009 | Terao et al. | |
| 2009/0142092 | A1 * | 6/2009 | Sato | 399/111 |
| 2009/0169228 | A1 * | 7/2009 | Yokoi et al. | 399/51 |
| 2009/0190953 | A1 * | 7/2009 | Okabe | 399/111 |
| 2010/0054813 | A1 * | 3/2010 | Tamaru et al. | 399/205 |

FOREIGN PATENT DOCUMENTS

| | | |
|---|---|---|
| JP | 4-212973 A | 8/1992 |
| JP | 2000-293085 A | 10/2000 |
| JP | 2001-175046 A | 6/2001 |
| JP | 2002-182529 | 6/2002 |
| JP | 2004-333959 | 11/2004 |

(Continued)

OTHER PUBLICATIONS

English Language Translation of Japanese Laid-open Application No. 2009-122391, Jun. 4, 2009.

(Continued)

*Primary Examiner* — Laura Martin
*Assistant Examiner* — Carlos A Martinez
(74) *Attorney, Agent, or Firm* — Fitzpatrick, Cella, Harper & Scinto

(57) ABSTRACT

An electrophotographic image forming apparatus for forming an image on a recording medium includes: a light emitting member having multiple light emitting elements provided side-by-side along a direction of an axis of an electrophotographic photosensitive drum of a process cartridge removably mounted to a mounting portion to subject the drum to exposure according to image information; a light emitting member support which supports the light emitting member, and is movable between an exposure position, at which the drum is subjected to exposure, and a retracted position, at which the light emitting member is retracted from the exposure position; and a moving member configured to move the light emitting member support between the exposure position and the retracted position in a state in which the light emitting member keeps parallel to the axis of the drum.

18 Claims, 7 Drawing Sheets

FOREIGN PATENT DOCUMENTS

| | | |
|---|---|---|
| JP | 2008-221587 | 9/2008 |
| JP | 2009-80394 | 4/2009 |
| JP | 2009-86151 | 4/2009 |
| JP | 2009-122391 | 6/2009 |
| JP | 2009-139943 | 6/2009 |
| JP | 2009-251231 | 10/2009 |
| JP | 2010-44406 | 2/2010 |

OTHER PUBLICATIONS

Office Action in Chinese Patent Application No. 20101057970.4, mailed Jan. 14, 2013 (with English translation).

* cited by examiner

ELECTROPHOTOGRAPHIC IMAGE FORMING APPARATUS WITH MOVABLE LIGHT EMITTING MEMBER SUPPORT

BACKGROUND OF THE INVENTION

1. Field of the Invention

The present invention relates to an electrophotographic image forming apparatus for forming an image on a recording medium in a state in which a process cartridge is removably mounted to an apparatus main body.

The electrophotographic image forming apparatus (hereinafter, referred to as an image forming apparatus) described herein forms an image on a recording medium by using an electrophotographic image forming process. As the image forming apparatus, there are given, for example, an electrophotographic copying machine, an electrophotographic printer (for example, color light emitting diode (LED) printer), a facsimile machine, and a word processor. Further, in a state in which the process cartridge (hereinafter, referred to as a cartridge) is removably mounted to an image forming apparatus main body (hereinafter, referred to as an apparatus main body), the process cartridge contributes to the electrophotographic image forming process for forming an image on a recording medium. In the cartridge, at least one of charging means, developing means, and cleaning means each serving as process means and an electrophotographic photosensitive member (hereinafter, referred to as a photosensitive member) are integrated into a cartridge, which is removably mounted to the apparatus main body. The charging means, the developing means, and the cleaning means, which act on the photosensitive member, are referred to as the process means. The cartridge can be mounted to and removed from the apparatus main body by a user him/herself, and hence the user him/herself can easily perform maintenance of the apparatus main body. Further, on the recording medium, the image forming apparatus forms an image, and the recording medium includes a paper sheet and an OHP sheet.

2. Description of the Related Art

Conventionally, there is known an image forming apparatus using an LED unit for subjecting a photosensitive member of a cartridge to exposure (Japanese Patent Application Laid-Open No. 2002-182539). The image forming apparatus includes a slide frame slidingly movable with respect to an apparatus main body. The slide frame bears multiple cartridges, an intermediate transfer member, and an LED frame provided with the LED unit. The LED frame is pivotably supported on the slide frame, and is arranged on the multiple cartridges. When a cartridge is replaced, the slide frame is pulled out from the apparatus main body. The LED frame on the slide frame is manually pivoted upward. The cartridge to be removed is pulled out of the slide frame upward. Then, a cartridge to be mounted is mounted to the slide frame. The LED frame is manually pivoted downward to be arranged on the cartridges. The slide frame is pushed into the apparatus main body. The cartridge is replaced in the above-mentioned procedure.

In the conventional image forming apparatus, the LED frame having the LED unit is pivotably attached to the apparatus main body (the slide frame). Therefore, a conventional technology requires a space to pivot the LED frame. In this context, in order to pivot the LED frame when a cartridge is replaced, it has been conceived to pull out the LED frame to the outside of the apparatus main body.

SUMMARY OF THE INVENTION

An object of the present invention is therefore to provide an electrophotographic image forming apparatus capable of moving a light emitting member support between an exposure position and a retracted position within a smaller space in comparison with a configuration in which the light emitting member support is pivoted. Another object of the present invention is to provide an electrophotographic image forming apparatus capable of making effective use of a space in the apparatus main body because a smaller space suffices for moving the light emitting member between the exposure position and the retracted position in comparison with a case of pivoting the light emitting member support.

In order to achieve the above-mentioned objects, the present invention provides an electrophotographic image forming apparatus for forming an image on a recording medium in a state in which a process cartridge, which has an electrophotographic photosensitive drum and process means for acting on the electrophotographic photosensitive drum, is removably mounted to an apparatus main body, the electrophotographic image forming apparatus including: a mounting portion to which the process cartridge is removably mounted, the mounting portion being provided in the apparatus main body; a light emitting member having multiple light emitting elements which are provided side-by-side along a direction of an axis of the electrophotographic photosensitive drum of the process cartridge mounted to the mounting portion, and which emit light according to image information in order to subject the electrophotographic photosensitive drum to exposure according to the image information; a light emitting member support configured to support the light emitting member, the light emitting member support being movable between an exposure position, at which the light emitting elements emit the light to subject the electrophotographic photosensitive drum to the exposure, and a retracted position, at which the light emitting member is retracted from the exposure position; and a moving member configured to move the light emitting member support between the exposure position and the retracted position in a state in which the light emitting member keeps parallel to the axis of the electrophotographic photosensitive drum.

According to the present invention, in comparison with the configuration in which the light emitting member support is pivoted, it is possible to move the light emitting member support between the exposure position and the retracted position within a smaller space.

According to the present invention, it is possible to make effective use of a space in the apparatus main body because a smaller space suffices for moving the light emitting member support between the exposure position and the retracted position in comparison with a case of pivoting the light emitting member support.

Further features of the present invention will become apparent from the following description of exemplary embodiments with reference to the attached drawings.

DESCRIPTION OF THE EMBODIMENT

Hereinafter, an embodiment of the present invention will be described with reference to the attached drawings.

(Electrophotographic Image Forming Apparatus)

Figure 1A:
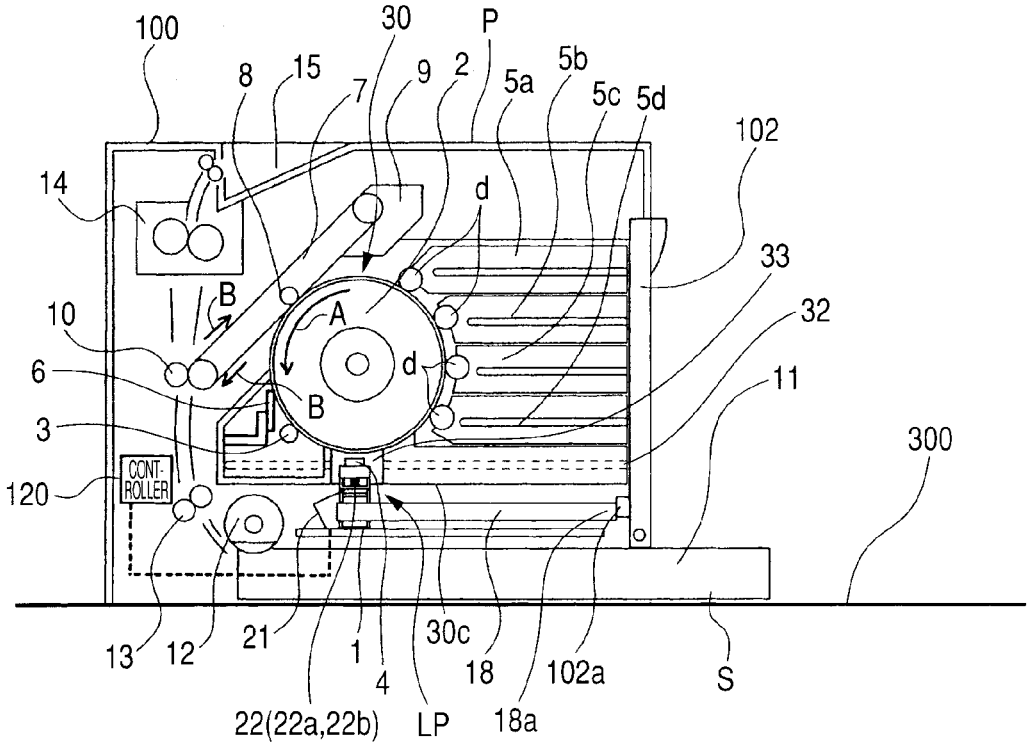
FIGS. 1A, 1B and 1C are sectional views of an apparatus main body according to an embodiment of the present invention.
Figure 1B:
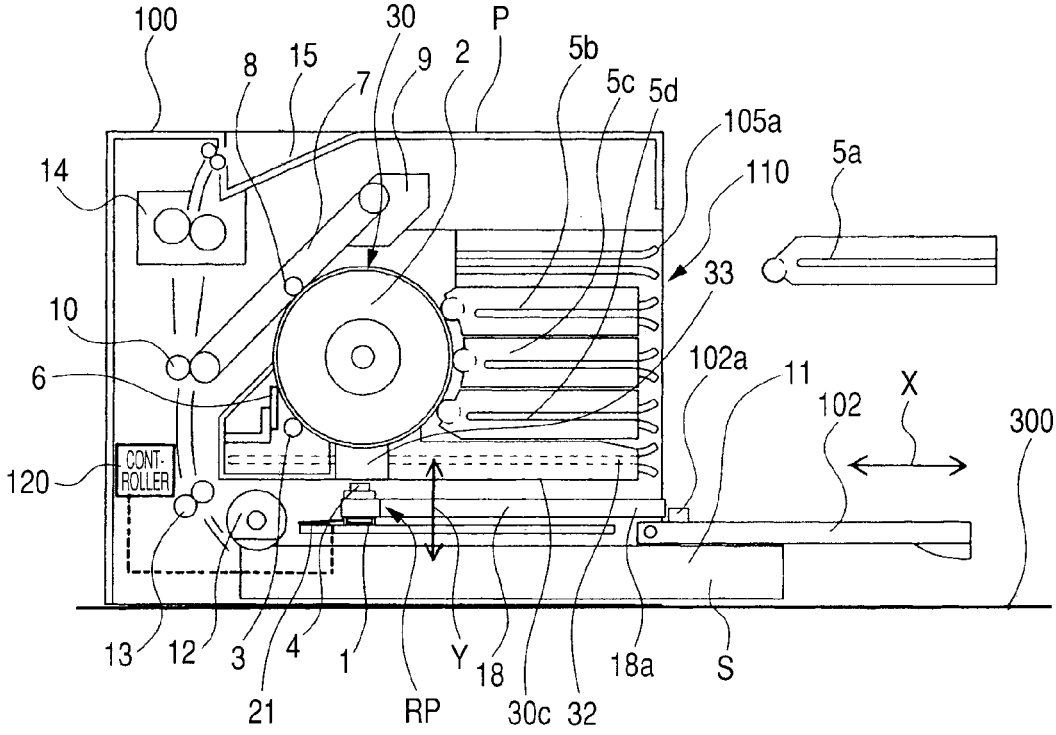
Figure 1C:
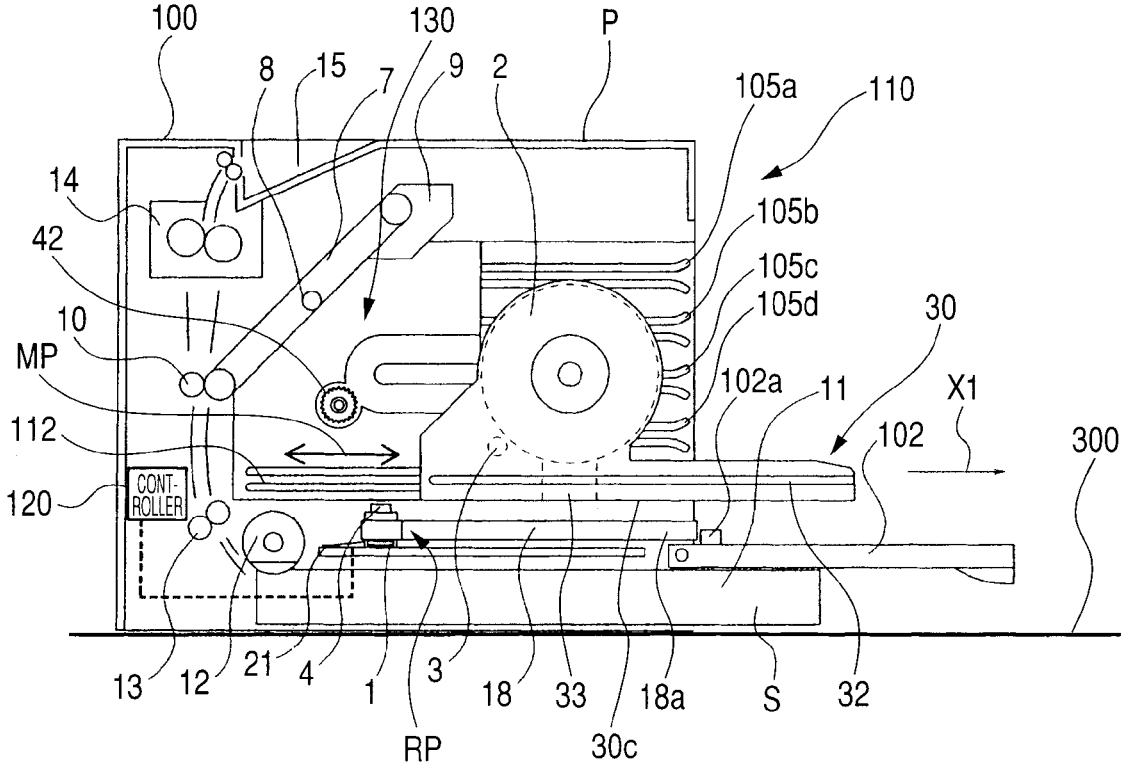
Figure 2:
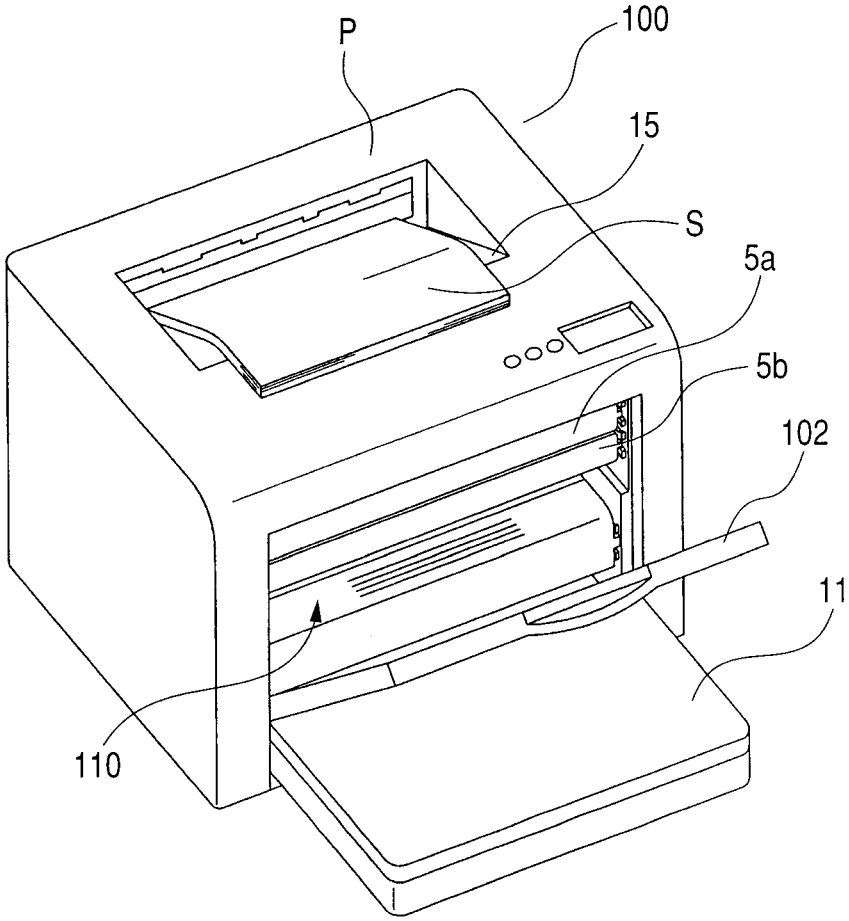
FIG. 2 is a perspective view of the apparatus main body according to the embodiment of the present invention.

A color electrophotographic image forming apparatus (hereinafter, referred to as an image forming apparatus) P, to which the embodiment of the present invention is applied, will be described. The image forming apparatus P is a full-color LED printer of a four color type. FIGS. 1A, 1B, and 1C are sectional views of an apparatus main body (hereinafter, referred to as a main body) 100 of the image forming apparatus P. FIG. 2 is a perspective view of the main body 100. In FIG. 2, there is opened a front door (an openable and closable member or an operating member) 102 for opening and closing an opening portion 110 provided in the main body 100. A process cartridge 30 and developing cartridges 5 are moved through the opening portion 110 when the process cartridge 30 and the developing cartridges 5 are mounted to or removed from the main body 100. The door 102 is movable between a closed position for closing the opening portion 110 and an open position for opening the opening portion 110. The main body 100 is a remainder of the image forming apparatus P other than the developing cartridges 5 and the process cartridge 30. The main body 100 is provided with a mounting portion 130 to which the process cartridge 30 is removably mounted. As described above, the main body 100 is provided with the opening portion 110 through which the process cartridge 30 passes when the process cartridge 30 is mounted to the mounting portion 130 or removed from the mounting portion 130. FIG. 1A is a sectional view of the image forming apparatus P in a state in which the door 102 is closed for performing an image forming operation. As illustrated in FIG. 1A, a drum-shaped electrophotographic photosensitive member (an electrophotographic photosensitive drum, hereinafter, referred to as drum) 2 is arranged at a substantially center portion of the main body 100. Around the drum 2, a charging roller (process means) 3, a light emitting member 4, an intermediate transfer belt 7, the developing cartridges 5 (5*a*, 5*b*, 5*c*, and 5*d*), and a cleaning device 6 are arranged. With this configuration, the main body 100 is reduced in size. The light emitting member 4 is arranged below a rotation axis L (see FIGS. 5A and 5B) of the drum 2 in the main body 100. The charging roller 3 uniformly charges the drum 2. The light emitting member 4 irradiates light onto a surface of the charged drum 2 to form an electrostatic latent image on the drum 2. The developing cartridges 5 develop and visualize the electrostatic latent image formed on the drum 2 with powder developer (hereinafter, referred to as toner) of corresponding colors (yellow, magenta, cyan, and black). The toner image formed on the drum 2 is transferred onto the intermediate transfer belt 7. After transferring, the cleaning device 6 removes the toner remaining on the drum 2.

Upon image formation, the drum 2 is first synchronized with rotation of the transfer belt 7, and is rotated in a direction (counterclockwise direction) indicated by an arrow A of FIG. 1A. The transfer belt 7 is rotated in a direction (clockwise direction) indicated by arrows B of FIG. 1A. The surface of the drum 2 is uniformly charged by the charging roller 3. Onto the charged surface of the drum 2, light irradiation of a yellow image is performed by the light emitting member 4, and an electrostatic latent image for yellow is formed on the drum 2. In order to develop the electrostatic latent image for yellow, a voltage having the same charging polarity and substantially the same potential as those of the drum 2 is applied to a developing roller "d" of the developing cartridge 5*a* containing yellow developer. In this way, yellow toner is caused to adhere to the electrostatic latent image for yellow formed on the drum 2, and thus a yellow toner image is formed. After that, a voltage having a polarity opposite to that of the toner is applied to a primary transfer roller 8 arranged inside the transfer belt 7, and then the yellow toner image on the drum 2 is primarily transferred onto the transfer belt 7. After the primary transfer of the yellow toner image is finished in the above-mentioned way, in a similar way of forming the yellow image, the electrostatic latent image formation is performed to form each of a magenta image, a cyan image, and a black image. The electrostatic latent images are respectively developed by the magenta, cyan, and black developing cartridges (5*b* to 5*d*) to form a magenta toner image, a cyan toner image, and a black toner image. The developing cartridge 5*b* contains magenta toner. The developing cartridge 5*c* contains cyan toner. The developing cartridge 5*d* contains black toner. Each of the developing cartridges 5 has the developing roller "d". The respective toner images are sequentially transferred and superimposed onto the transfer belt 7 by the primary transfer roller 8. In the meantime, a secondary transfer roller 10 is out of contact with the transfer belt 7. Further, in the meantime, a cleaning unit 9 is also out of contact with the transfer belt 7. Meanwhile, sheets (recording mediums) S stacked and contained in a cassette 11 provided in a lower portion of the main body 100 are separated one by one from the cassette 11 by a sheet feeding roller 12, and are fed to a registration roller pair 13. The registration roller pair 13 sends out the sheet S to a secondary transfer nip between the transfer belt 7 and the secondary transfer roller 10 in timed relation to the toner images superimposed on the transfer belt 7. At this time, the transfer roller 10 is held in pressure-contact with the transfer belt 7. The voltage having the polarity opposite to that of the toner is applied to the transfer roller 10. Four-color toner images superimposed on the transfer belt 7 are collectively and secondarily transferred onto the surface of the conveyed sheet S. The sheet S onto which the toner images are transferred is fed to a fixing device 14. In the fixing device 14, the sheet S is heated and pressurized, and the toner images are fixed on the sheet S. In this way, an image is formed on the sheet S. The sheet S is discharged from the fixing device 14 to a discharging portion of an upper cover 15 provided in an upper portion of the main body 100.

(Light Emitting Member)

Figure 7:
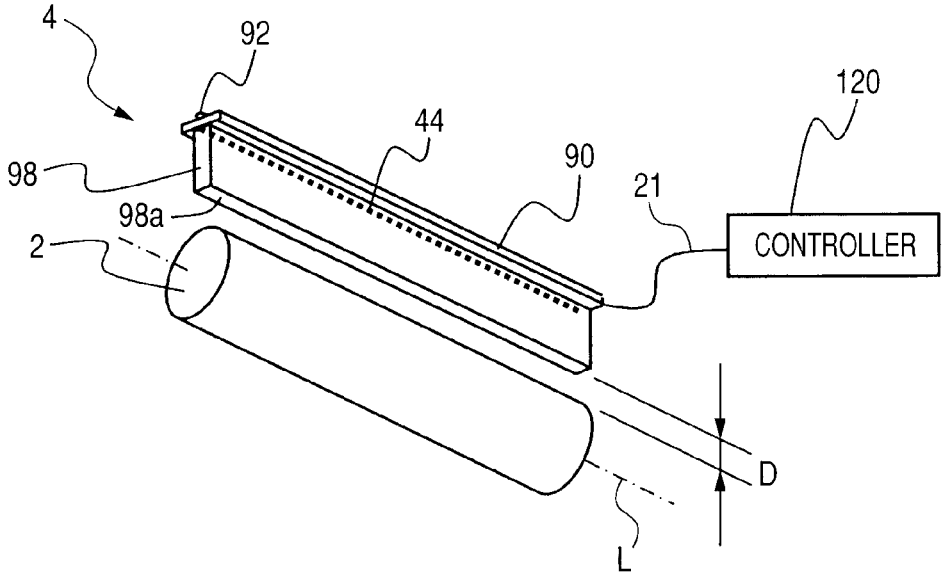
FIG. 7 is a perspective view of a light emitting member.

The light emitting member 4 (FIG. 7) has multiple light emitting elements 44 provided side-by-side along a longitudinal direction (a direction of a rotation axis L) of the drum 2 of the process cartridge 30 mounted to the mounting portion 130. The longitudinal direction of the drum 2 is a direction orthogonal to a mounting/removing direction X of the process cartridge 30. The light emitting elements 44 emit light according to image information output from a controller 120, and subject the drum 2 to exposure. As the light emitting elements 44, there are used, for example, electroluminescent elements such as liquid crystal elements, semiconductor light emitting diodes (LEDs), and organic electroluminescence elements (organic EL elements). FIG. 7 is a perspective view of the light emitting member 4. The light emitting member 4 has a substrate 90. The substrate 90 is supported by a holder (not shown). The multiple light emitting elements 44 are provided side-by-side in line on a front side of the substrate 90. A driver IC 92 is provided on a back side of the substrate 90. The light emitting member 4 is arranged along the longitudinal direction of the drum 2. With this configuration, the light emitting elements 44 are arranged along the longitudinal direction of the drum 2. The light emitting elements 44 are electrically connected to the driver IC 92. The driver IC 92 controls a light emitting operation of the light emitting elements 44. The substrate 90 is connected to the controller 120 of the main body 100 through a flexible flat cable (FFC) 21. The controller 120 is provided inside the apparatus main body. The driver IC 92 performs the light emitting operation of the light emitting elements 44 in response to an image information signal output from the controller 120. A SELFOC (registered trademark) lens 98 is bonded to the light emitting elements 44. A surface 98*a* of the lens 98 on a side on which the drum 2 is provided is flat. The lens 98 condenses the light emitted from the light emitting elements 44 and forms an image on the drum 2. At an exposure position LP (see FIGS. 1A and 5A) at which the light emitting elements 44 emit the light and subject the drum 2 to exposure, the light emitting member 4 is arranged close to the drum 2. At the exposure position LP, a distance D between the surface of the drum 2 and the surface 98*a* of the lens 98 of the light emitting member 4 is regulated to be the predetermined distance.

(Process Cartridge)

Figure 3A:
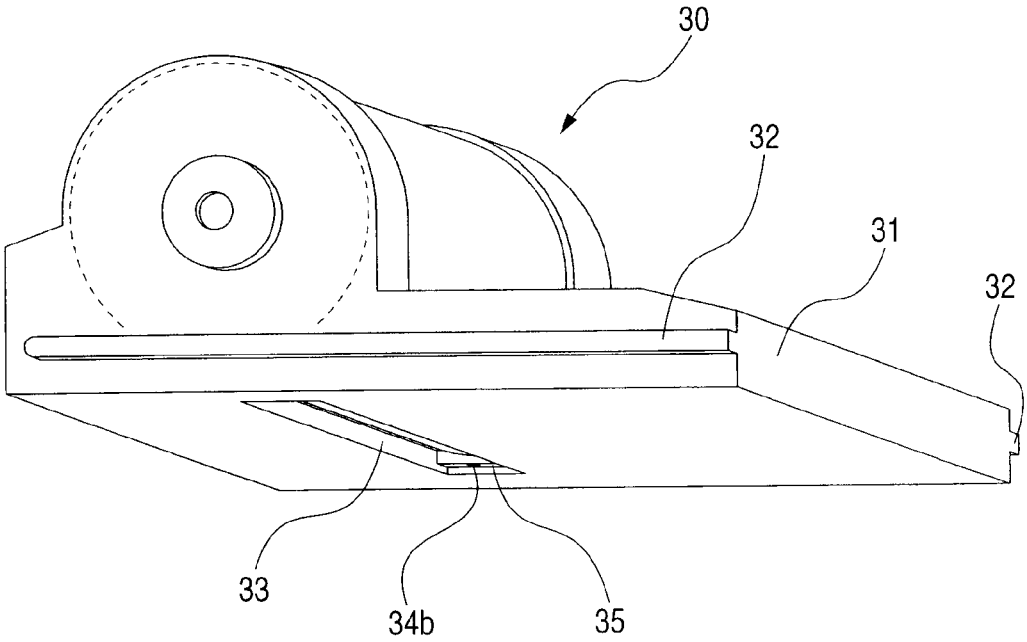
FIGS. 3A and 3B are perspective views of a process cartridge according to the embodiment of the present invention.
Figure 3B:
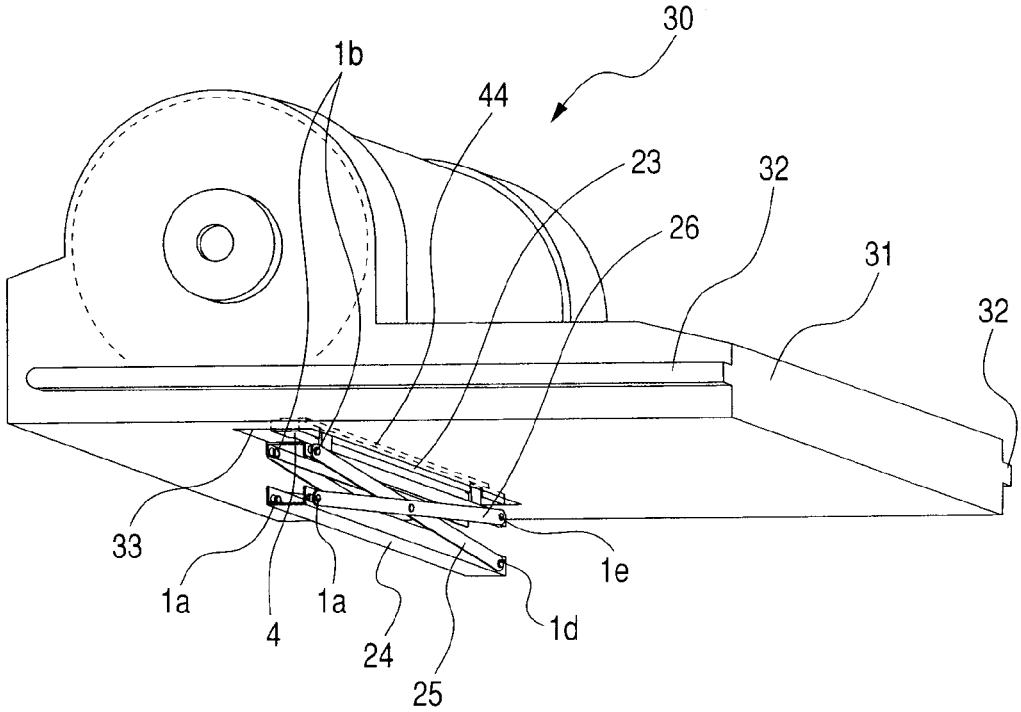

FIGS. 3A and 3B are perspective views of the cartridge 30. The cartridge 30 can be mounted to and removed from the main body 100 in a horizontal direction. As illustrated in FIG. 1A, the cartridge 30 integrally incorporates the drum 2, the charging roller 3, and the cleaning device 6. In this embodiment, there is described a so-called separate-type process cartridge which integrally includes the drum 2 and process means other than developing means. However, the present invention is applicable also to an image forming apparatus using a so-called integral-type process cartridge which integrally includes the photosensitive drum and the developing means. As illustrated in FIG. 3A, the cartridge 30 includes a cartridge frame 31 integrally incorporating the drum 2, the charging roller 3, and the cleaning device 6. On both side portions of the frame 31 in the longitudinal direction of the drum 2, guided portions (cartridge-side guides) 32 are provided to protrude from the both side portions thereof, respectively. The guided portions 32 extend in the direction orthogonal to the longitudinal direction of the drum 2. On inner sides of both side plates of the main body 100, there are provided guide portions (main-body-side guides) 112 extending horizontally along a moving path MP of the cartridge 30 (FIG. 1C). The guided portions 32 are inserted in grooves of the guide portions 112. When the cartridge 30 is mounted to or removed from the main body 100, the guided portions 32 are engaged with the guide portions 112 to guide the cartridge 30 along the mounting/removing direction X. As illustrated in FIG. 3B, in a state in which the cartridge 30 is mounted to the mounting portion 130, an opening portion 33 allowing the light emitting member 4 to penetrate is formed in a bottom of the frame 31. The opening portion 33 is provided along the direction of the axis L (the longitudinal direction) of the drum 2. The drum 2 is exposed to the outside through the opening portion 33. Owing to provision of the opening portion 33, it is possible to reduce an exposed area of the drum 2. Thus, it is possible to reduce a risk that the light emitting member 4 is contaminated with developer. Further, by allowing the light emitting member 4 to penetrate the opening portion 33, the light emitting member can be arranged close to a position (the exposure position LP) optimum to subject the drum 2 to exposure. In this case, the light emitting member 4 is equally spaced apart from the drum 2 along the longitudinal direction of the drum 2. Therefore, the multiple light emitting elements 44 provided side-by-side in the light emitting member 4 are equally spaced apart from the drum 2 along the axial direction of the drum 2. As described above, the light emitting member 4 has the multiple light emitting elements 44 which are provided side-by-side along the axial direction of the drum 2 of the cartridge 30 mounted to the mounting portion 130, and which emit the light according to the image information for subjecting the drum 2 to exposure according to the image information.

Figure 5A:
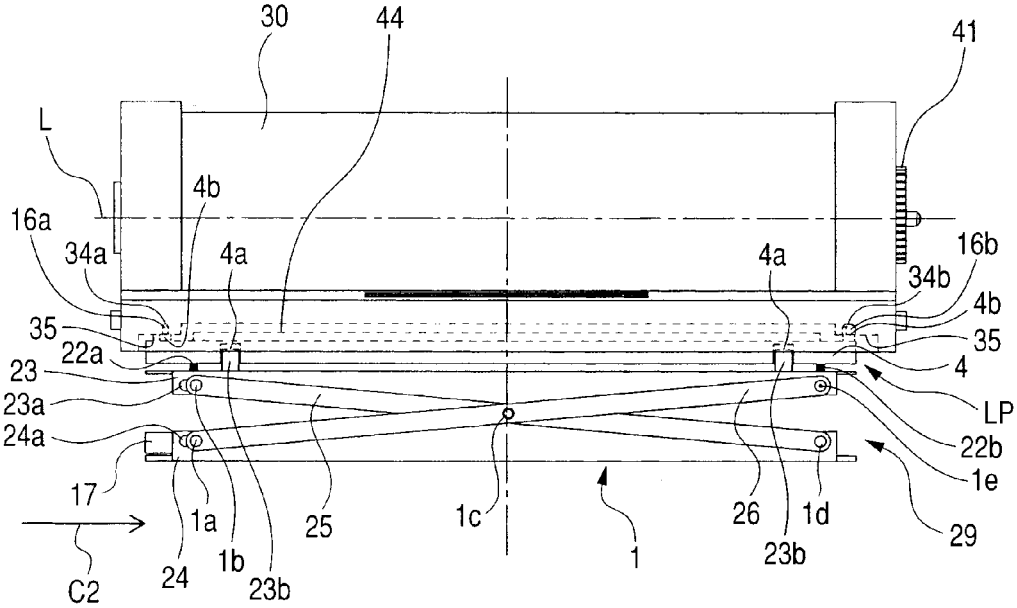
FIGS. 5A and 5B are front views of the penetrating and retracting device according to the embodiment of the present invention.
Figure 5B:
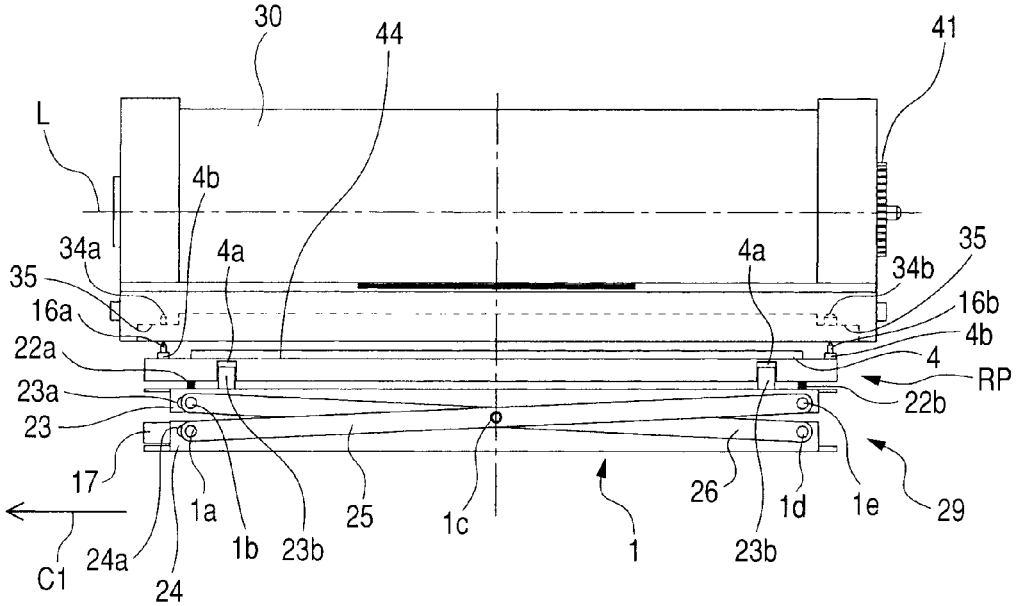

A drum gear 41 for rotating the drum 2 is provided at an end portion of the drum 2. As illustrated in FIGS. 5A and 5B, the drum gear 41 protrudes from the end portion of the cartridge 30. When the cartridge 30 is mounted to the mounting portion 130, the gear 41 is engaged with a drive gear 42 provided in the main body 100. The gear 42 is driven by a drive source (not shown) provided in the main body 100 so as to rotate the gear 41 to rotate the drum 2.

(Penetrating and Retracting Device)

Figure 4:
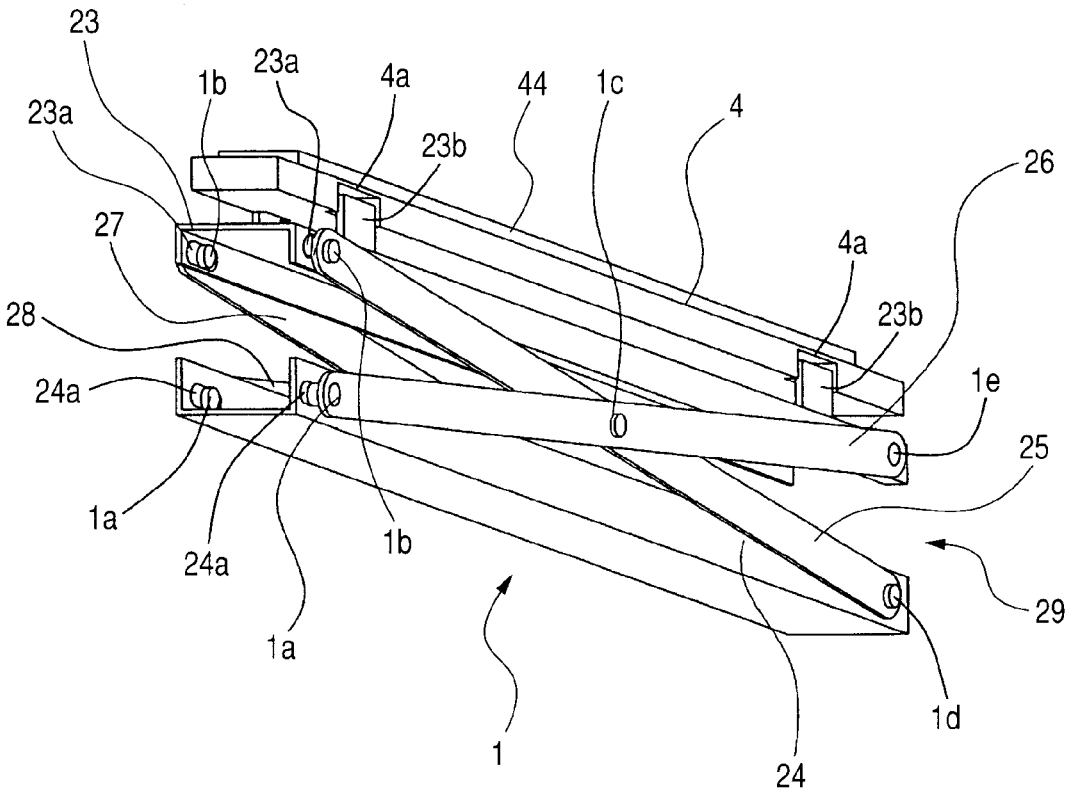
FIG. 4 is a perspective view of a penetrating and retracting device according to the embodiment of the present invention.

FIG. 4 is a perspective view of a penetrating and retracting device (a retracting device) 1. FIGS. 5A and 5B are front views of the penetrating and retracting device 1. The penetrating and retracting device 1 has a light emitting member support 23 and a moving member 29. The light emitting member 4 is supported through elastic members 22 (22*a* and 22*b*) so as to be movable with respect to the light emitting member support 23. Each of the elastic members 22 may be, for example, a compression spring, an elastic foam member, or rubber. The elastic member 22*a* and the elastic member 22*b* are respectively arranged on one end side and the other end side in the longitudinal direction of the light emitting member support along a short-side direction thereof. The elastic members 22*a* and 22*b* are arranged between the light emitting member support 23 and the light emitting member 4. Therefore, the light emitting member 4 is movable in a vertical direction (perpendicular direction) with respect to the light emitting member support 23. The light emitting member support 23 is supported by the moving member 29 so as to be movable with respect to a base member 24. The base member 24 is fixed to the main body 100. Rods 25, 26, 27, and 28 constitute the moving member 29. The light emitting member support 23 is supported by the base member 24 through the rods 25, 26, 27, and 28 rotatably connected to the light emitting member support 23 and the base member 24 by rotation fulcrums 1*a*, 1*b*, 1*c*, 1*d*, and 1*e*. A cam 17 is fixed to the rotation fulcrum 1*a*. The penetrating and retracting device (the retracting device) 1 comprises the support 23, the moving member 29, the base member 24, and the cam 17. The penetrating and retracting device 1 retracts the light emitting member 4 in a direction Y perpendicular to the mounting/removing direction X of the cartridge 30 (see FIG. 1B). That is, the penetrating and retracting device 1 can retract the light emitting member 4 from the exposure position LP to a retracted position RP in a direction perpendicular to a tangent (X direction) of the drum 2. Further, the penetrating and retracting device 1 can make the light emitting member 4 move from the retracted position RP to the exposure position LP in the direction perpendicular to the tangent of the drum 2. That is, the penetrating and retracting device 1 can move the light emitting member 4 between the retracted position RP and the exposure position LP in a state of keeping the light emitting member 4 parallel to the longitudinal direction of the drum 2. Here, the perpendicular direction corresponds to a right angle in terms of design, and does not need to be a right angle in terms of mathematics. That is, the perpendicular direction described herein includes manufacturing error and installation error, and may be practically a right angle. The light emitting member 4 is retracted in the direction Y perpendicular to the mounting/removing direction X. Therefore, in comparison with a space necessary for conventional retraction performed by pivoting a light emitting member, the light emitting member 4 can be retracted from the moving path MP of the cartridge 30 within a smaller space. That is, within the smaller space, the light emitting member 4 can be moved between the retracted position RP and the exposure position LP. In this embodiment, the base member 24 is provided in a direction parallel to the mounting/removing direction of the cartridge 30. Therefore, the direction Y perpendicular to the tangent (X direction) of the drum 2 corresponds to the direction Y perpendicular to the mounting/removing direction X of the cartridge 30. However, the present invention is not limited to this embodiment, and the base member 24 may be arranged so that the light emitting member 4 penetrates and retracts in the direction Y perpendicular to the tangent (X direction) of the drum 2. The support 23 supports the light emitting member 4. The support 23 is movable between the exposure position LP, at which the light emitting elements 44 emit the light to thereby subject the photosensitive drum 2 to exposure, and the retracted position RP, at which the light emitting member 4 is retracted from the exposure position LP.

Each of the rods 25 and 26 is attached to one side end in the short-side direction of the light emitting member support 23 and one side end in the short-side direction of the base member 24. Further, each of the rods 27 and 28 is attached to the other side end in the short-side direction of the light emitting member support 23 and the other side end in the short-side direction of the base member 24. The rotation fulcrums 1*a* slidably move within horizontally-elongated holes 24*a* formed in the base member 24. The rotation fulcrums 1*b* slidably move within horizontally-elongated holes 23*a* formed in the support 23. Here, the horizontal direction corresponds to a direction horizontal to the base member 24 (an installation surface 300 of the main body 100). When the cam 17 is moved in a direction indicated by an arrow C2 of FIG. 5A by interlocking means described later, lower end portions of the rods 26 and 28 connected to the rotation fulcrums 1*a* are moved in the direction indicated by the arrow C2. The rods 25 to 28 are rotatable about the rotation fulcrums 1*c*. Lower end portions of the rods 25 and 27 are rotatably supported on the base member 24 by the rotation fulcrums 1*d*. Upper end portions of the rods 26 and 28 are rotatably supported on the support 23 by the rotation fulcrums 1*e*. With this configuration, when the cam 17 is moved in the direction indicated by the arrow C2, the support 23 is moved upward in the vertical direction in parallel to the rotation axis L through the rotation fulcrums 1*a* to 1*e* and the rods 25 to 28 serving as the moving member 29. Here, the vertical direction corresponds to a direction vertical to the base member 24 (the installation surface 300 of the main body 100). Then, the light emitting member 4 is inserted into the opening portion 33 of the cartridge 30. Here, inserting of the light emitting member 4 into the opening portion 33 means that the light emitting member 4 penetrates from the opening portion 33 formed in an outer wall 30*c* (FIGS. 1A to 1C) of the cartridge 30 into the inside of the outer wall 30*c*. The opening portion 33 is formed into an elongated thin shape (a slot) along the longitudinal direction of the drum 2. The light emitting member 4 can enter the inside of the opening portion 33, and hence the light emitting member 4 can be located at the optimum exposure position LP. In addition, according to this embodiment, the light emitting member 4 can be moved between the exposure position LP and the retracted position RP in a state of keeping parallel to the longitudinal direction of the drum 2. Therefore, it is possible to make the size of the opening portion 33 smaller. That is, in comparison with a case where the light emitting member 4 is pivoted to penetrate the inside of the opening portion 33, it is possible to make the size of the opening portion 33 smaller.

At this time, the surface 98*a* of the lens 98 of the light emitting member 4 is kept (supported) by a positioning mechanism (described later) at the predetermined distance D from the surface of the drum 2. At this time, the support 23 is located at the exposure position LP, at which the light emitting elements 44 emit the light according to the image information and subject the drum 2 to exposure. The exposure position LP is a position at which the light emitting elements 44 emit the light to thereby subject the drum 2 to exposure, and at which the multiple light emitting elements 44 are aligned side-by-side along the rotation axis L of the drum 2 and each of the multiple light emitting elements 44 is equally spaced apart from the drum 2. As the light emitting elements 44, there are used, for example, electroluminescent elements such as liquid crystal elements, semiconductor light emitting diodes (LEDs), and organic electroluminescence elements (organic EL elements).

In this embodiment, each of the multiple light emitting elements 44 is equally spaced apart from the drum at the exposure position LP. However, the present invention is not limited thereto. For example, when the lenses 98 respectively corresponding to the multiple light emitting elements 44 are different in dimension, distances between the multiple light emitting elements 44 and the drum 2 are different. The distances between the multiple light emitting elements 44 and the drum 2 are set so that the light emitted from the light emitting elements 44 is condensed by the lenses 98 and an image is formed on the drum 2. Therefore, depending on specifications of the lenses 98, the multiple light emitting elements 44 may be arranged in a curved manner so that the distances between the light emitting elements 44 and the drum 2 are short at the both end portions in the direction of the rotation axis L of the drum 2, and that the distances are long at the center portion in the direction of the rotation axis L thereof. Or, the multiple light emitting elements 44 may be arranged in a curved manner so that the distances between the light emitting elements 44 and the drum 2 are long at the both end portions in the direction of the rotation axis L of the drum 2, and that the distances are short at the center portion in the direction of the rotation axis L thereof. The direction of the rotation axis L corresponds to the longitudinal direction of the drum 2.

Meanwhile, when the cam 17 is moved in a direction indicated by an arrow C1 of FIG. 5B by the interlocking means described later, the rotation fulcrums 1*a* fixed to the cam 17 are also moved in the direction indicated by the arrow C1. Owing to the movement of the rotation fulcrums 1*a*, by an action of the moving member 29 (rods 25 to 28), the support 23 is moved downward in the vertical direction in parallel to the rotation axis L. Here, the vertical direction corresponds to a direction vertical to the base member 24 (the installation surface 300 of the main body 100). Then, the light emitting member 4 is moved out of the opening portion 33 of the cartridge 30. At this time, the support 23 is located at the retracted position RP at which the light emitting member 4 is retracted from the moving path MP (FIG. 1C) along which the cartridge 30 is moved to be mounted to or be removed from the mounting portion 130. According to this embodiment, in comparison with a large space to pivot a conventional light emitting member, within a smaller space in the main body 100, the support 23 can be retracted from the moving path MP of the cartridge 30. That is, the support 23 (the light emitting member 4) can assume the exposure position LP and the retracted position RP within the small space.

(Guide Member)

As described above, the light emitting member 4 is supported by the penetrating and retracting device 1 through the elastic members 22 (22*a* and 22*b*). With this configuration, the light emitting member 4 is swingable with respect to the apparatus main body 100. The light emitting member 4 has groove holes 4*a* serving as guided members, which are formed at both side ends in the short-side direction in both end portions in the longitudinal direction (the same as rotation axis L direction) of the light emitting member 4. Protrusions (guide members) 23*b* are respectively provided at one end portion and the other end portion in the short-side direction of the support 23 in one end portion in the longitudinal direction of the support 23. Further, protrusions (guide members) 23*b* are respectively provided at one end portion and the other end portion in the short-side direction of the support 23 in the other end portion in the longitudinal direction thereof. The four protrusions 23*b* are engaged with the four groove holes 4*a* formed in the light emitting member 4. Thus, swinging movement of the light emitting member 4 in the longitudinal direction of the drum 2 is guided (regulated).

When the moving member 29 moves the support 23 from the retracted position RP to the exposure position LP, the light emitting member 4 is brought into contact with the cartridge 30. When the light emitting member 4 is in contact with the cartridge 30, the elastic member 22*a* provided at the one end portion in the longitudinal direction of the support 23 and the elastic member 22*b* provided at the other end portion are elastically deformed. The elastic members 22*a* and 22*b* are provided at the center in the short-side direction of the support 23 (FIG. 1A). The light emitting member 4 is pressed against the cartridge 30 by elastic forces of the elastic members 22*a* and 22*b*, and is moved with respect to the support 23 due to elastic deformation of the elastic members 22*a* and 22*b*. Owing to engagement between the groove holes (guided members) 4*a* and the protrusions (guide members) 23*b*, the movement of the light emitting member 4 caused by the elastic deformation of the elastic members 22*a* and 22*b* is guided. Therefore, even if the cartridge 30 is mounted to the mounting portion 130 in an inclined manner, the light emitting member 4 can be stably inclined according to the inclination of the cartridge 30. As described above, the moving member 29 moves the support 23 such that the support is movable between the exposure position LP and the retracted position RP in a state in which the light emitting member 4 keeps parallel to the axis of the drum 2.

(Positioning Member)

Positioning surfaces (positioning members) 35 are provided on one end portion and the other end portion in the longitudinal direction of the opening portion 33 of the cartridge 30, respectively. A positioning hole 34*a* is formed in one positioning surface 35, and an elongated positioning hole 34*b* is formed in the other positioning surface 35. Positioning bosses (positioned members) 4*b* are provided on the both end portions of the light emitting member 4, respectively. A positioning pin 16*a* and a positioning pin 16*b* are provided on an upper portion of one boss 4*b* and an upper portion of the other boss 4*b*, respectively. As illustrated in FIG. 5A, when the support 23 is located at the exposure position LP, the pin 16*a* of the light emitting member 4 is inserted into the hole 34*a* of the cartridge 30, and the pin 16*b* is inserted into the elongated hole 34*b*. Owing to an engagement between the pin 16*a* and the hole 34*a* and an engagement between the pin 16*b* and the elongated hole 34*b*, the light emitting member 4 is positioned with respect to the cartridge 30. The light emitting member 4 is pressed against the cartridge 30 by the elastic forces of the elastic members 22. The bosses 4*b* of the light emitting member 4 are engaged with the positioning surfaces 35 of the cartridge 30, and thus each of the light emitting elements 44 is positioned so as to be equally spaced apart from the drum 2. Even when the cartridge 30 is mounted to the mounting portion 130 of the apparatus main body 100 in an inclined manner within an allowable range, the light emitting member 4 can be inclined according to the inclination of the cartridge 30 due to the elastic deformation of the elastic members 22. In other words, the light emitting member 4 can be inclined in the longitudinal direction (the rotation axial direction) of the drum 2. Accordingly, the drum 2 and each of the light emitting elements 44 can be positioned at an equal interval. At this time, the four protrusions 23*b* of the support 23 and the four groove holes 4*a* of the light emitting member 4 guide the light emitting member 4 so as not to hamper the inclination of the light emitting member 4 following the inclination of the cartridge 30.

The support 23 is linearly moved between the retracted position RP and the exposure position LP while being in parallel to the base member 24 (the installation surface 300 of the main body 100). That is, the support 23 is movable between the exposure position LP and the retracted position RP in a state in which the light emitting member 4 keeps parallel to the longitudinal direction of the drum 2. Note that, in the case of this embodiment, the base member 24 (the installation surface 300 of the main body 100) is provided in parallel to the longitudinal direction of the drum 2 of the cartridge 30 mounted to the mounting portion 130. When the support 23 is located at the exposure position LP, the light emitting member 4 is pressed against the cartridge 30 by the elastic forces of the elastic members 22. In a case where the cartridge 30 is mounted to the mounting portion 130 in an inclined manner, the elastic member 22*a* provided at the one end portion in the longitudinal direction of the support 23 and the elastic member 22*b* provided at the other end portion are elastically deformed, and thus the light emitting member 4 is inclined according to the inclination of the cartridge 30. Therefore, it is possible to position the drum 2 of the cartridge 30 and each of the light emitting elements 44 of the light emitting member 4 at an equal interval therebetween.

Therefore, even when the cartridge 30 is mounted on the mounting portion 130 in an inclined manner, the distance D between the surface of the drum 2 and the surface 98*a* of the lens 98 of the light emitting member 4 is reliably kept to be the predetermined distance. The predetermined distance is a distance suitable to subject the drum 2 to exposure. In this embodiment, the predetermined distance is in a range from 2 mm to 3 mm. According to this embodiment, as long as the predetermined distance is in the above-mentioned numerical range, the drum 2 is satisfactorily subjected to exposure through the light emission performed by the light emitting elements 44 according to the image information. A distance measured from the surface of the drum 2 to the light emitting elements 44 so as to cover the lens 98 is in a range from 7 mm to 8 mm. However, a lens thickness and depth of focus are changed depending on a change in the specification of the lens 98, and hence the above-mentioned predetermined distance is changed. Depending on the specification of the lens 98, the distance measured from the surface of the drum 2 to the light emitting elements 44 so as to cover the lens 98 can be set to, for example, 17 mm±0.8 mm, 10 mm±0.5 mm, 5 mm±0.3 mm, and 4 mm±0.3 mm.

(Interlocking Means)

Figure 6:
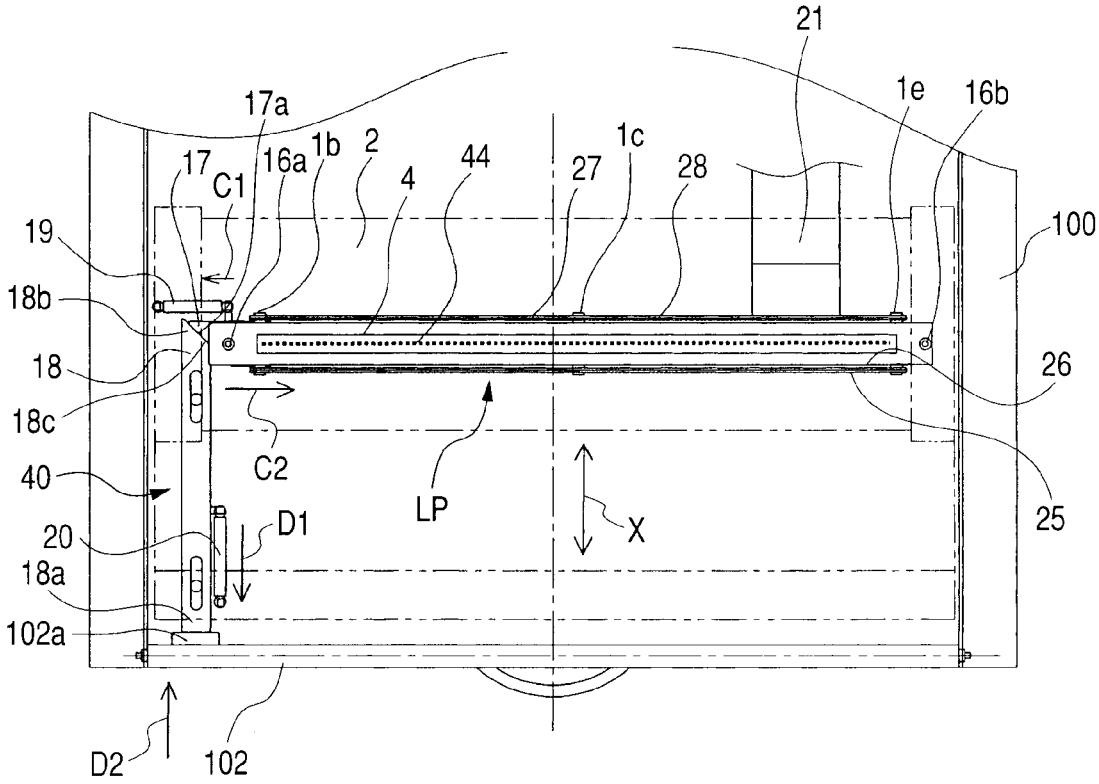
FIG. 6 is a plan view of interlocking means according to the embodiment of the present invention.

The apparatus main body 100 includes interlocking means 40 which automatically moves the support 23 of the penetrating and retracting device 1 between the exposure position LP and the retracted position RP in association with the opening and closing operations of the front door (the openable and closable member or the operating member) 102. That is, the interlocking means 40 automatically moves the support 23 located on the penetrating and retracting device 1 to the exposure position LP in association with the operation (a second operation) of closing the door 102. Further, the interlocking means 40 automatically moves the support 23 located on the penetrating and retracting device 1 to the retracted position RP in association with the operation (a first operation) of opening the door 102. Here, the door 102 is an operating member which is operated to be opened and closed by a user when the cartridges 5 and 30 are mounted to or removed from the main body 100. The interlocking means 40 includes a cam spring (an elastic member) 19 serving as a biasing member, a link 18, a link spring (an elastic member) 20 serving as a biasing member, and a link pushing portion 102*a* provided on the door 102 (FIG. 6). The spring 19 is coupled between the main body 100 and the cam 17. The spring 19 biases the cam 17 fixed to the rotation fulcrums 1*a* in a direction indicated by an arrow C1 of FIG. 6. That is, the spring 19 elastically biases the support 23 on the penetrating and retracting device 1 to the retracted position RP. The link 18 is attached to the main body 100 so as to be movable in a direction perpendicular to the moving directions C1 and C2 of the cam 17. A forward end portion 18*a* of the link 18 is brought into contact with the link pushing portion 102*a* provided on the door 102. A rear end portion 18*b* of the link 18 is brought into contact with the cam 17. The spring 20 is coupled between the main body 100 and the link 18. The link 18 is elastically biased in a direction indicated by an arrow D1 of FIG. 6 by an elastic force of the spring 20. That is, when the door 102 is closed, the link 18 is brought into contact with the link pushing portion 102*a* by the elastic force (biasing force) of the spring 20.

When a user closes the door 102 (the second operation), the link pushing portion 102*a* provided on the door 102 is brought into contact with the forward end portion 18*a* of the link 18. Then, the pushing portion 102*a* pushes the link 18 against the elastic force of the spring 20 in a direction D2 opposite to the direction indicated by the arrow D1. When the link 18 is moved in the direction indicated by the arrow D2, the engagement between an inclined surface 18*c* of the rear end portion 18*b* of the link 18 and an inclined surface 17*a* of the cam 17 (FIG. 6) causes the cam 17 and the rotation fulcrums 1*a* to move in the direction indicated by the arrow C2. When the rotation fulcrums 1*a* are moved in the direction indicated by the arrow C2, the support 23 located on the penetrating and retracting device 1 is moved to the exposure position LP. Meanwhile, when a user opens the door 102 (the first operation), the link pushing portion 102*a* is disengaged from the forward end portion 18*a* of the link 18. Thus, the link 18 is moved in the direction indicated by the arrow D1 by the elastic force of the spring 20. When the link 18 is moved in the direction indicated by the arrow D1, the cam 17 and the rotation fulcrums 1*a* are moved in the direction indicated by the arrow C1 by the elastic force (the biasing force) of the spring 19. When the cam 17 and the rotation fulcrums 1*a* are moved in the direction indicated by the arrow C1, the support 23 located on the penetrating and retracting device 1 is moved to the retracted position RP.

The operating member is not limited to the door 102, and may be, for example, an operating lever (not shown). For example, the following configuration may be adopted. Specifically, in the configuration, when a user pulls the operating lever provided on the inside of the door 102 (the first operation), the pushing portion 102*a* provided on the operating lever is disengaged from the forward end portion 18*a* of the link 18. Further, when a user pushes the operating lever forward (the second operation), the pushing portion 102*a* is engaged with the forward end portion 18*a* of the link 18. As described above, the interlocking means 40 moves the support 23 from the exposure position LP to the retracted position RP in association with the first operation (the operation of opening the door 102 or the operation of pulling the operating lever) of the operating member (the door 102 or the operating lever). Further, the interlocking means 40 moves the support 23 from the retracted position RP to the exposure position LP in association with the second operation of the operating member (the operation of closing the door 102 or the operation of pushing the operating lever forward).

The interlocking means 40 is not limited to the above-mentioned configuration, and an appropriate configuration is applicable to the interlocking means 40.

(Replacing Operation for Cartridge)

The developing cartridges 5 can be mounted to and removed from the apparatus main body 100 in a substantially horizontal direction (with respect to the installation surface 300). For example, when the yellow toner is consumed, it is necessary to replace the cartridge 5*a* of the cartridges 5 of respective colors. As illustrated in FIG. 1B, a user opens the door 102 of the main body 100. A user pulls out the cartridge 5*a* having consumed the toner to the outside of the main body 100 through the opening portion 110. A fresh cartridge 5*a* filled with yellow toner is mounted to a developing cartridge mounting portion 105*a*, and the door 102 is closed. Thus, replacement of the cartridge 5*a* is completed. The developing cartridges 5*b*, 5*c*, and 5*d* of colors other than yellow can be replaced similarly to the yellow cartridge 5*a*.

Meanwhile, when the drum 2 is replaced, a user opens the door 102 of the main body 100. Then, all the cartridges 5*a* to 5*d* are taken out of the developing cartridge mounting portions 105 (105*a*, 105*b*, 105*c*, and 105*d*) to the outside of the main body 100 (FIG. 1C). In association with the operation of opening the door 102, the engagement between the pushing portion 102*a* of the door 102 and the forward end portion 18*a* of the link 18 is released. With reference to FIG. 6, the link 18 is pushed out in the direction indicated by the arrow D1 by the elastic force (biasing force) of the spring 20. Owing to the movement of the link 18, the cam 17 held in contact with the rear end portion 18*b* of the link 18 is also moved in the direction indicated by the arrow C1 of FIG. 6 by the self-weight of the light emitting member 4 and the elastic force of the spring 19. Thus, the rotation fulcrums 1*a* fixed to the cam 17 are also moved in the direction indicated by the arrow C1 at the same time. The support 23 for the light emitting member 4 is moved to the retracted position RP by the moving member 29 (as illustrated in FIG. 5B). In this way, before the cartridge 30 is removed from the mounting portion 130, the moving member 29 retracts the support 23 from the exposure position LP to the retracted position RP within the main body 100 in the direction Y perpendicular to the moving path MP. As illustrated in FIG. 1B, when the support 23 is located at the retracted position RP, the light emitting member 4 is pushed downward in the vertical direction. Further, the light emitting member 4 gets out of the opening portion 33 of the cartridge 30. Accordingly, as illustrated in FIG. 1C, the cartridge 30 can be pulled out in a removing direction X1 to be removed from the main body 100. When the cartridge 30 is removed from the main body 100, the light emitting member 4 is located not outside of the main body 100 but within the main body 100. Therefore, it is possible to prevent the light emitting member 4 from being contaminated and damaged.

The flat cable 21 electrically connects the light emitting member 4 with the controller 120 provided in the main body 100. The cable 21 transmits an electric signal from the controller 120 to the light emitting member 4. The cable 21 is creased in advance, and hence, as illustrated in FIG. 1B, the cable 21 is folded and contained below the light emitting member 4 when the light emitting member 4 is moved to the retracted position RP. The cable 21 is folded compactly, and hence the layout and design for downsizing of the main body 100 are facilitated.

Meanwhile, in a case of mounting the cartridge 30, a user performs operations reverse to the above-mentioned removing operations of the cartridge 30. At the time of mounting the cartridge 30, the guided portions 32 of the cartridge 30 are inserted into the grooves of the guide portions 112 of the main body 100. The cartridge 30 is horizontally inserted into the main body 100 through the opening portion 110 of the main body 100 in a mounting direction opposite to the removing direction X1. The cartridge 30 is positioned by a positioning portion (not shown) so as to be mounted to the mounting portion 130. Next, the developing cartridges 5*a* to 5*d* are inserted into the main body 100, and the door 102 is closed. The pushing portion 102*a* provided on the door 102 is brought into contact with the forward end portion 18*a* of the link 18. The pushing portion 102*a* pushes the link 18 in the direction indicated by the arrow D2 against the elastic force of the spring 20 in association with the operation of closing the door 102 (the second operation). The rear end portion 18*b* of the link 18 pushes the cam 17 in the direction indicated by the arrow C2 of FIG. 6. In this way, a force is transmitted to the rotation fulcrums 1*a* fixed to the cam 17, and the rods 26 and 28 supported by the rotation fulcrums 1*a* are actuated. Thus, the moving member 29 moves the support 23 to the exposure position LP. After the cartridge 30 is mounted to the mounting portion 130, the moving member 29 moves the support 23 from the retracted position RP to the exposure position LP within the main body 100 in the direction perpendicular to the moving path MP. The direction perpendicular to the moving path MP corresponds to the direction perpendicular to the base member 24 (the installation surface 300 of the main body 100). The light emitting member 4 supported by the support 23 through the elastic members 22 is moved upward substantially in parallel to the base member 24. That is, the light emitting member 4 is moved between the retracted position RP and the exposure position LP while keeping the parallel state. The pin 16*a* provided on the light emitting member 4 is inserted into the hole 34*a* formed in the cartridge 30, and the pin 16*b* is inserted into the elongated hole 34*b*. Thus, the light emitting member 4 is positioned with respect to the cartridge 30. Further, the light emitting member 4 is biased upward by the elastic forces of the elastic members 22, and the positioning surfaces 35 of the cartridge 30 and the positioning bosses 4*b* of the light emitting member 4 are brought into contact with each other. With this configuration, the distance D between the surface 98*a* of the lens 98 of the light emitting member 4 and the surface of the drum 2 is kept to be the predetermined distance necessary for exposure, and the lens 98 and the drum 2 are positioned. A series of operations as described above is performed in association with the operation of closing the door 102 (the second operation), and then the series of operations is completed.

The configuration in which the light emitting member 4 is moved between the retracted position RP and the exposure position LP while keeping parallel to the longitudinal direction of the drum 2 is not limited to the above-mentioned configuration. For example, the following configuration may be adopted. Specifically, in the configuration, one end and the other end in the longitudinal direction of the light emitting member 4 are fitted to the main-body-side guides (for example, grooves). Then, the light emitting member 4 is moved in a direction of coming close to the drum 2 along the guides by an elastic force of a spring. Thus, the light emitting member 4 is moved from the retracted position RP to the exposure position LP. Further, the light emitting member 4 is moved in a direction of moving away from the drum 2 along the guides with use of a lever, etc. Thus, the light emitting member 4 is moved from the exposure position LP to the retracted position RP.

As described above, according to this embodiment, before the process cartridge 30 is removed from the mounting portion 130, the support 23 can be moved within the main body 100 in the direction perpendicular to the moving path MP of the cartridge 30. That is, the support 23 can be moved between the exposure position LP and the retracted position RP while keeping parallel to the longitudinal direction of the drum 2. Therefore, in comparison with a case of pivoting the support 23, it is possible to make the space necessary to move the support 23 smaller. Therefore, within the smaller space in the main body 100, the support 23 can be retracted from the moving path MP of the cartridge 30. Further, according to this embodiment, when the developing cartridges 5 are replaced, it is unnecessary to expose the light emitting member 4 to the outside of the main body 100. Further, the light emitting member 4 is retracted downward in association with the opening and closing operations of the door when the developing cartridges 5 are replaced. Therefore, the light emitting member 4 can remain within the main body 100 also when the developing cartridges 5 are replaced. Accordingly, it is possible to prevent the light emitting member 4 from being contaminated and damaged. Further, it is possible to improve reliability of the image forming apparatus.

Further, according to this embodiment, the mounting/removing direction of the process cartridge 30 corresponds to the direction orthogonal to the longitudinal direction of the light emitting member 4. Therefore, the cartridge 30 can be mounted and removed through the opening portion 110 provided in a front surface of the main body 100. Therefore, it is unnecessary to provide an opening portion, through which the cartridge 30 is mounted and removed, in a side plate of the main body 100. Accordingly, it is possible to strengthen rigidity of the main body 100. The main body 100 can keep the strong rigidity, and hence downsizing of the main body 100 is possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-196727, filed Aug. 27, 2009, and No. 2009-290044, filed Dec. 22, 2009, which are hereby incorporated by reference herein in their entirety.

What is claimed is:

1. An electrophotographic image forming apparatus for forming an image on a recording medium in a state in which a process cartridge, which has a photosensitive drum and a process member configured to act on the photosensitive drum, is removably mounted to a main body of the apparatus, the image forming apparatus comprising:

a mounting portion to which the process cartridge is removably mounted, the mounting portion being provided in the main body of the apparatus;

a light emitting member having multiple light emitting elements which are provided side-by-side along a direction of an axis of the photosensitive drum of the process cartridge mounted to the mounting portion, and which emit light according to image information in order to subject the photosensitive drum to exposure according to the image information;

a support member configured to support the light emitting member, the support member being movable between an exposure position, at which the light emitting elements emit the light to subject the photosensitive drum to the exposure, and a retracted position, at which the light emitting member is retracted from the exposure position and located within the main body of the apparatus;

an elastic member disposed between the light emitting member and the support member to make the light emitting member movable with respect to the support member;

an opening portion provided in the main body of the apparatus, the process cartridge passing through the opening portion when the process cartridge is mounted to the mounting portion and removed from the mounting portion;

an openable and closable member configured to open and close the opening portion; and an interlocking member configured to move the support member from the exposure position to the retracted position in association with an opening operation of the openable and closable member, and to move the support member from the retracted position to the exposure position in association with a closing operation of the openable and closable member, wherein the process cartridge is movable in a direction perpendicular to the direction of the axis of the photosensitive drum so as to be removably mountable to the main body of the apparatus, and wherein, when the support member is moved from the retracted position to the exposure position by the interlocking member, the elastic member pressed the light emitting member toward the photosensitive drum to determine a position of the light emitting member with respect to the photosensitive drum.

2. An electrophotographic image forming apparatus according to claim 1, wherein the process cartridge further comprises a positioning member, wherein the light emitting member comprises a positioned member engaged with the positioning member, and wherein, when the support member is located at the exposure position, the positioned member is engaged with the positioning member, and each of the light emitting elements is positioned to be equally spaced apart from the photosensitive drum.

3. An electrophotographic image forming apparatus according to claim 1, further comprising:

a guided member provided on the light emitting member; and a guide member provided on the support member to guide the guided member, wherein the elastic member is elastically deformed by bringing the light emitting member into contact with the process cartridge when the support member is moved from the retracted position to the exposure position by the interlocking member, and wherein the guide member and the guided member guide the light emitting member which is moved by elastic deformation of the elastic member.

4. An electrographic image forming apparatus according to claim 3, wherein, when the support member is moved from the retracted position to the exposure position by the interlocking member, the support member is moved while keeping a state of the support member parallel to the axis for the photosensitive drum.

5. An electrophotographic image forming apparatus according to claim 1, wherein the light emitting member is arranged below the axis of the photosensitive drum when the process cartridge is mounted to the mounting portion.

6. An electrophotographic image forming apparatus according to claim 1, wherein the process cartridge is provided with an opening portion into which the light emitting member is inserted, and wherein, when the support member is located at the exposure position, the light emitting member penetrates to an inside of an outer wall of the process cartridge through the opening portion.

7. An electrophotographic image forming apparatus according to claim 1, further comprising:

a controller provided in the main body of the apparatus; and a flat cable configured to electrically connect the controller with the light emitting member, wherein, when the support member is moved to the retracted position, the flat cable is folded below the light emitting member.

8. An electrophotographic image forming apparatus according to claim 1, wherein the process cartridge is removably mountable to the main body of the apparatus while the support member is located at the retracted position.

9. An electrophotographic image forming apparatus according to claim 1, wherein the openable and closable member is rotated about an axis in a lower position of the openable and closable member so as to be opened.

10. An electrophotographic image forming apparatus for forming an image on a recording medium in a state in which a cartridge, which has a process member configured to act on a photosensitive drum, is removably mounted to a main body of the apparatus, the image forming apparatus comprising:

a mounting portion to which the cartridge is removably mounted, the mounting portion being provided in the main body of the apparatus;

a first member and a second member composing the main body of the apparatus, one of the first member and the second member being openable and closable with respect to the other of the first member and the second member, the cartridge being passed through an opening formed by one of the first member and the second member being opened with respect the other so that the cartridge is mounted to the mounting potion and removed from the mounting potion;

a light emitting member having multiple light emitting elements which are provided side- by-side along a direction of an axis of the photosensitive drum, and which emit light according to image information in order to subject the photosensitive drum to exposure according to the image information;

a support member configured to support the light emitting member, the support member being movable between an exposure position, at which the light emitting elements emit the light to subject the photosensitive drum to the exposure, and a retracted position, at which the light emitting member is retracted from the exposure position and located within the first member;

an elastic member disposed between the light emitting member and the support member to make the light emitting member movable with respect to the support member; and an interlocking member configured to move the support member from the exposure position to the retracted position in association with a first operation of opening one of the first member and the second member with respect to the other, and to move the support member from the retracted position to the exposure position in association with a second operation of closing one of the first member and the second member with respect to the other, wherein the cartridge is movable in a direction perpendicular to the direction of the axis of the photosensitive drum so as to be removably mountable to the main body of the apparatus, and wherein, when the support member is moved from the retracted position to the exposure position by the interlocking member, the elastic member presses the light emitting member toward the photosensitive drum to determine a position of the light emitting member with respect to the photosensitive drum.

11. An electrophotographic image forming apparatus according to claim 10, wherein the cartridge further comprises a positioning member, wherein the light emitting member comprises a positioned member engaged with the positioning member, and wherein, when the support member is located at the exposure position, the positioned member is engaged with the positioning member, and each of the light emitting elements is positioned to be equally spaced apart from the photosensitive drum.

12. An electrophotographic image forming apparatus according to claim 10, further comprising:

a guided member provided on the light emitting member; and a guide member provided on the support member to guide the guided member, wherein the elastic member is elastically deformed by bringing the light emitting member into contact with the process cartridge when the support member is moved from the retracted position to the exposure position by the interlocking member, and wherein the guide member and the guided member guide the light emitting member which is moved by elastic deformation of the elastic member.

13. An electrophotographic image forming apparatus according to claim 12, wherein, when the support member is moved from the retracted position to the exposure position by the interlocking member, the support member is moved while keeping a state of the support member parallel to the axis of the photosensitive drum.

14. An electrophotographic image forming apparatus according to claim 10, wherein the cartridge has the photosensitive drum.

15. An electrophotographic image forming apparatus according to claim 10, wherein the light emitting member is arranged below the axis of the photosensitive drum when the cartridge is mounted to the mounting portion.

16. An electrophotographic image forming apparatus according to claim 10, wherein the cartridge is provided with an opening portion into which the light emitting member is inserted, and wherein, when the support member is located at the exposure position, the light emitting member penetrates to an inside of an outer wall of the cartridge through the opening portion.

17. An electrophotographic image forming apparatus according to claim 10, further comprising:

a controller provided in the main body of the apparatus; and a flat cable configured to electrically connect the controller with the light emitting member, wherein, when the support member is moved to the retracted position, the flat cable is folded below the light emitting member.

18. An electrophotographic image forming apparatus according to claim 10, wherein the cartridge is removably mountable to the main body of the apparatus while the support member is located at the retracted position.

* * * * *